US009795260B2

(12) United States Patent
Castellini

(10) Patent No.: US 9,795,260 B2
(45) Date of Patent: Oct. 24, 2017

(54) AXILLARY SUPPORT DEVICE FOR SHOWER STALLS

(71) Applicant: PAULTECH S.R.L., Rome (IT)

(72) Inventor: Paolo Castellini, Rome (IT)

(73) Assignee: Paultech S.R.L., Rome (IT)

( * ) Notice: Subject to any disclaimer, the term of this patent is extended or adjusted under 35 U.S.C. 154(b) by 0 days.

(21) Appl. No.: 15/031,638

(22) PCT Filed: Sep. 24, 2014

(86) PCT No.: PCT/EP2014/070378
§ 371 (c)(1),
(2) Date: Apr. 22, 2016

(87) PCT Pub. No.: WO2015/062789
PCT Pub. Date: May 7, 2015

(65) Prior Publication Data

US 2016/0262586 A1 Sep. 15, 2016

(30) Foreign Application Priority Data

Nov. 4, 2013 (IT) ..... RM2013A0606

(51) Int. Cl.
*A47K 17/02* (2006.01)
*A47K 3/12* (2006.01)
*A47K 3/28* (2006.01)

(52) U.S. Cl.
CPC ..... *A47K 17/024* (2013.01); *A47K 3/125* (2013.01); *A47K 3/281* (2013.01)

(58) Field of Classification Search
CPC ..... A47K 3/125; A47K 3/281; E04F 11/1802; E04F 11/1804; E04F 11/1808
See application file for complete search history.

(56) References Cited

U.S. PATENT DOCUMENTS 2,810,137 A * 10/1957 Olsson ..... A47K 3/125 4/575.1
4,373,221 A * 2/1983 Wilson ..... A47K 3/125 4/559

(Continued)

FOREIGN PATENT DOCUMENTS

CA 2226652 A1 3/1999
DE 29702094 U1 3/1997

(Continued)

OTHER PUBLICATIONS

International Search Report regarding Application No. PCT/EP2014/070378, dated Dec. 15, 2014; ISA/EP.

(Continued)

*Primary Examiner* — Janie Loeppke
(74) *Attorney, Agent, or Firm* — Harness, Dickey & Pierce, P.L.C.

(57) ABSTRACT

The object of the present invention is an axillary support device (1) for a handicapped user of a common shower stall provided with at least one flat wall, substantially constituted by a pair of transverse arms (2, 3) fixed to the flat wall of the shower stall by means of a pair of vertical supports (4, 5) firmly anchored to said wall. Said transverse arms (2, 3) are arranged in a manner so as to be substantially perpendicular, in the longitudinal direction thereof, to the wall to which they are fixed; such arms (2, 3) are shaped in a manner so as to have one end (6, 7) bent upward, one end constrained (8, 9) to the vertical supports (4, 5) and they are provided with a covering made of soft and impermeable material. The vertical position and the horizontal position of said transverse arms (2, 3) can be adjusted, the latter being translatable along said vertical supports (4, 5) and lockable in pre-established positions. The device (1) also comprises a retention band (10) adapted to support the user and housed in the bent end (6) of a first (2) of said transverse arms, extractable (Continued)

therefrom, and reversibly constrainable to the bent end (7) of the second (3) of said transverse arms, in a manner so as to be arranged transversely to said arms.

15 Claims, 6 Drawing Sheets

(56) References Cited

U.S. PATENT DOCUMENTS

| | | | | |
|---|---|---|---|---|
| 5,738,112 | A * | 4/1998 | Brod | A47K 17/02 128/869 |
| 8,166,588 | B1 * | 5/2012 | Haessly | A47K 17/02 5/662 |
| 2008/0216227 | A1 * | 9/2008 | Felmeri | A47K 17/024 4/511 |

FOREIGN PATENT DOCUMENTS

| | | | |
|---|---|---|---|
| EP | 0182308 | A2 | 5/1986 |
| FR | 2536830 | A1 | 6/1984 |
| GB | 2310586 | A | 9/1997 |
| WO | WO-2006023539 | A2 | 3/2006 |

OTHER PUBLICATIONS

Written Opinion regarding Application No. PCT/EP2014/070378, dated Dec. 15, 2014.

* cited by examiner

AXILLARY SUPPORT DEVICE FOR SHOWER STALLS

CROSS REFERENCE TO RELATED APPLICATIONS

This application is a U.S. National Phase under 35 U.S.C. 371 of International Application No. PCT/EP2014/070378, filed Sep. 24, 2014, and published in English as WO 2015062789 on May 7, 2015. This application is based on and claims priority to Italian Patent Application No. RM2013A000606, filed Nov. 4, 2013. The entire disclosures of the above applications are incorporated herein by reference.

CONTEXT OF THE INVENTION

The present invention refers to a sanitary device for shower stalls, for the purpose of facilitating the cleaning operations of people with limited physical mobility.

The personal hygiene operations of handicapped people, affected by limited physical mobility, are indeed particularly difficult and often require the assistance of specialized personnel, and even in this case they may still be difficult.

For people with limited physical mobility, it is intended people who are only able to carry out limited movements, in particular with reference to the lower limbs. Examples include the elderly and people with defects of the lower limbs or pelvis, which can be congenital or acquired, caused by acute trauma, infection, chronic pathologies or neurological diseases.

Further examples of people with limited physical mobility are people who are able to have full functionality of only one lower limb, e.g. people who have had one leg amputated, who possibly make use of artificial prostheses. In addition, also for people affected by heterometry of the lower limbs, i.e. the difference of length of the bone segments of the lower limbs, it is particularly difficult to carry out normal personal cleaning operations when using a common shower stall, above all for problems connected to the fact that they can stand on their feet by leaning asymmetrically.

For the purpose of facilitating such hygienic operations, there are accessory devices for shower stalls. For example, special seats are available on the market that can be fixed, with adjustable and/or tiltable height, which are generally fixed to the wall of a shower stall. In this manner, a handicapped person can wash himself when in a seated position. Though such solution is advantageous for certain categories of people, it is not very suitable for people who are unable to be in a seated position, such as people affected by arthrosis, with spinal column problems, who are unable to bend their knee, due for example to patellar chondropathy, or people who have sustained a fracture of the lower limbs and are obliged to wear a cast for fractures. In addition, remaining in seated position, the cleaning operations are often incomplete and not very effective.

Particular handles are also available on the market that are fixed to one or more walls of a shower stall and which are arranged longitudinally thereto. Such handles provide support to people with limited physical mobility, but they are often inadequate, since they are generally fixed in position and oblige the user to employ at least one hand in order to support himself therewith.

BRIEF DESCRIPTION OF THE INVENTION

In order to overcome the aforesaid drawbacks, surpassing the solutions offered by the prior art, an innovative axillary support device 1 for common shower stalls provided with at least one flat wall is described and claimed herein.

In the simplest embodiment thereof, such device 1, object of the present invention, is substantially constituted by a pair of transverse arms 2, 3 fixed to the wall of a common shower stall by means of a pair of vertical supports 4, 5 firmly anchored to said wall. Said transverse arms 2, 3 are arranged in a manner so as to be substantially perpendicular, in the longitudinal direction thereof, to the wall to which they are fixed, they are shaped in a manner so as to have one end 6, 7 bent upward, one end constrained 8, 9 to the vertical supports 4, 5 and they are provided with a covering made of soft and impermeable material, such as polymer foams or rubbers. Another particular and advantageous characteristic of the device 1 is that the vertical position and the horizontal position of said transverse arms 2, 3 is adjustable. Indeed, the latter can be translated along said vertical supports 4, 5 and locked in pre-established positions by means of any one suitable mechanism, known at the state of the art, or alternatively said transverse arms 2, 3 are reversibly constrained to said vertical supports 4, 5 in pre-established positions, by means of any one suitable quick coupling/release mechanism or system, known at the state of the art. A further particular and advantageous characteristic of the claimed axillary support device 1 is given by a retention band 10 housed in and extractable from the bent end 6 of a first 2 of said transverse arms, and reversibly constrainable to the bent end 7 of the second 3 of said transverse arms, in a manner so as to be arranged transversely to such arms.

DETAILED DESCRIPTION OF THE INVENTION

Figure 1:
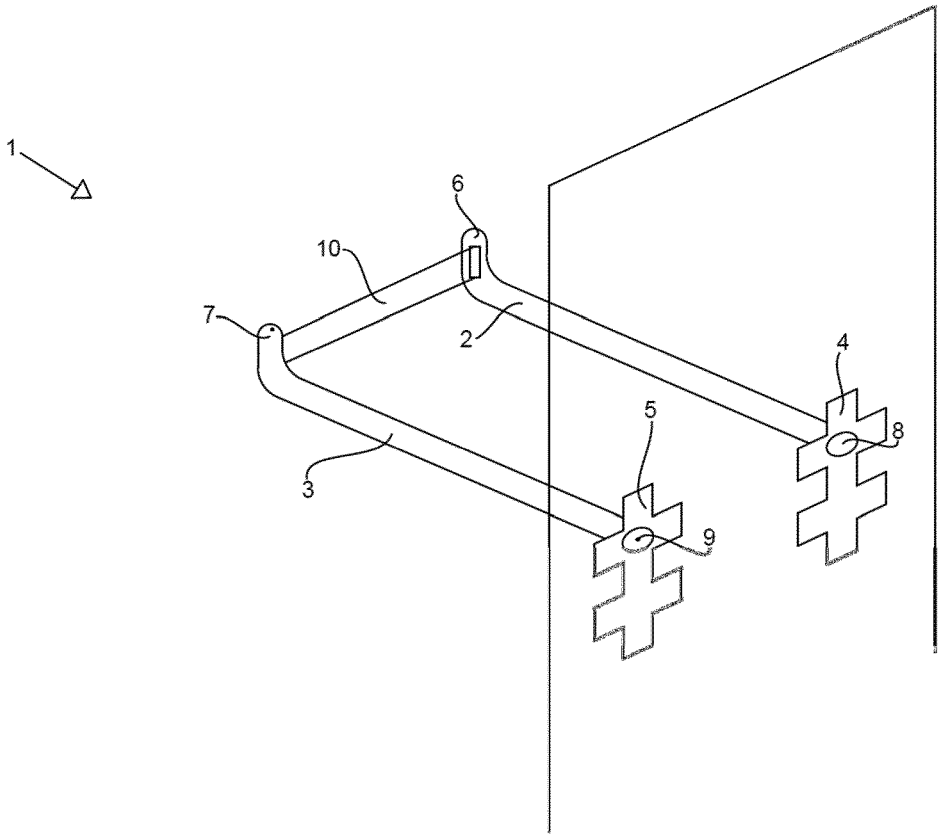
FIG. 1 is a schematic illustration in perspective view of the axillary support device 1, in which the transverse arms 2, 3 are observed with the free ends 6, 7 bent as an elbow and the ends 8, 9 constrained to the respective vertical supports 4, 5, said transverse arms 2, 3 being arranged in a manner substantially perpendicular, along the longitudinal direction thereof, to the wall to which they are constrained by means of said vertical supports 4, 5. Also observed is the retention band 10 housed inside the bent end 6 of the transverse arm 2, said band being reversibly constrained to the bent end 7 of the transverse arm 3.
Figure 2:
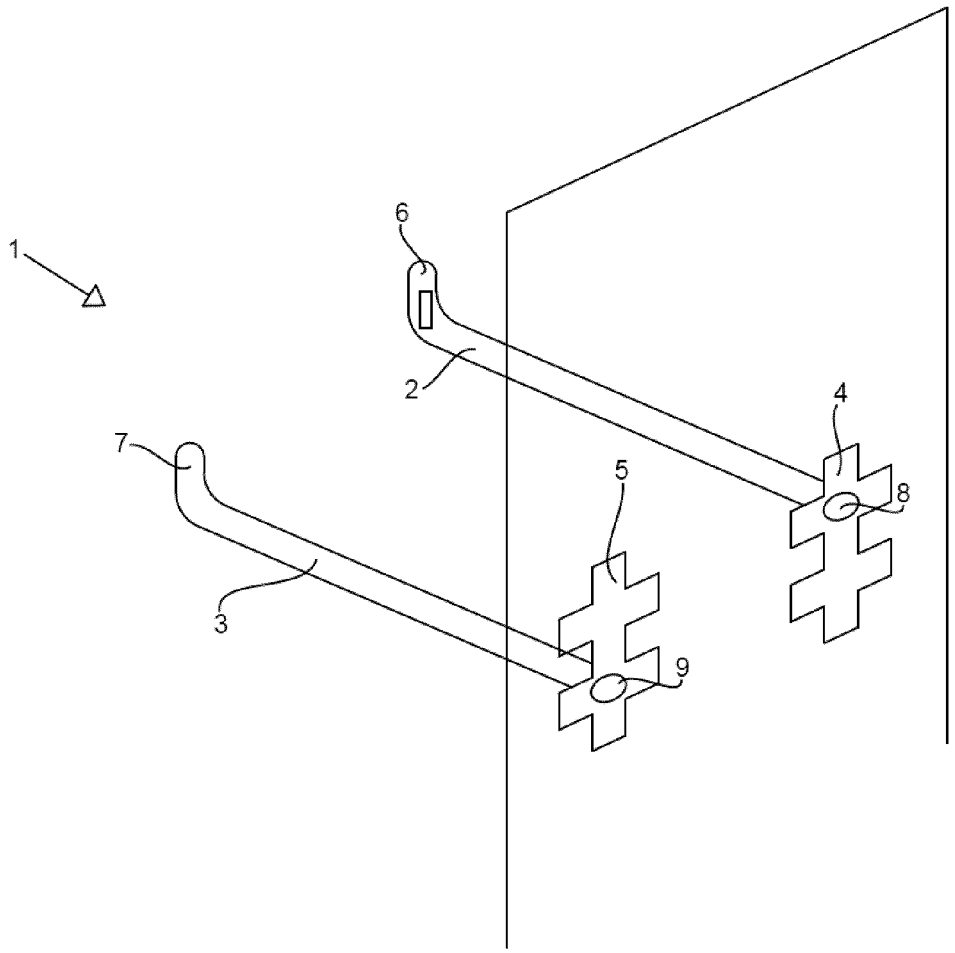
FIG. 2 is a schematic illustration in perspective view of the axillary support device 1 according to the previous FIG. 1, in which it is observed that the height position of the transverse arm 3 is lower than the height position of the transverse arm 2; it is also observed that the retention band 10 is wound inside the bent end 6 of the transverse arm 2.
Figure 3:
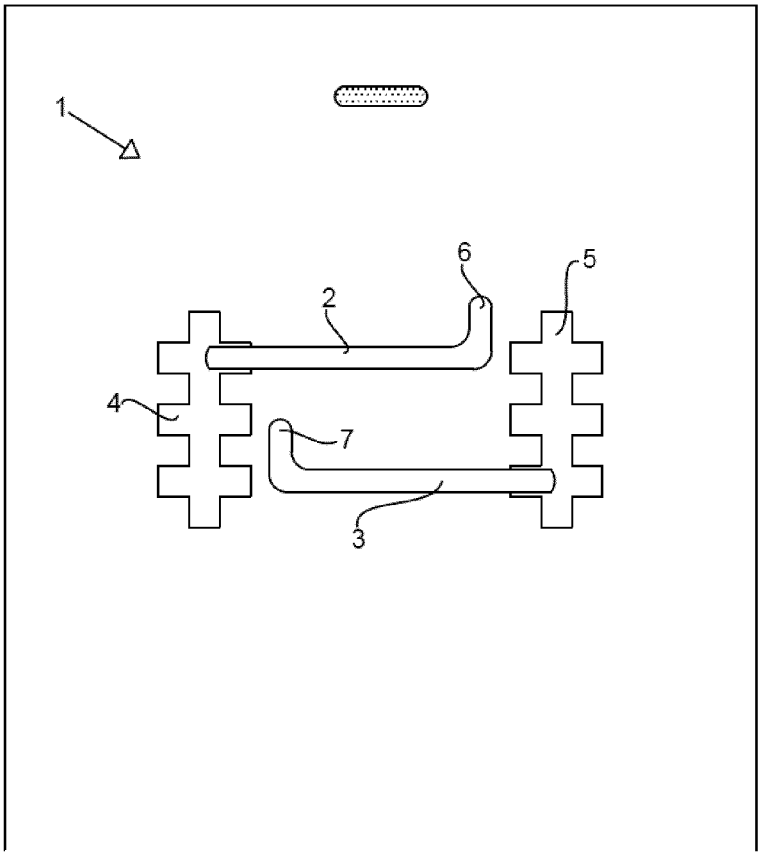
FIG. 3 is a schematic illustration in front view of the device 1 according to one embodiment, in which the transverse arms 2, 3 are observed, locked at different heights, pivoted to the respective vertical supports 4, 5 and rotated inwardly, substantially being parallel to the wall of the shower to which they are constrained.
Figure 4:
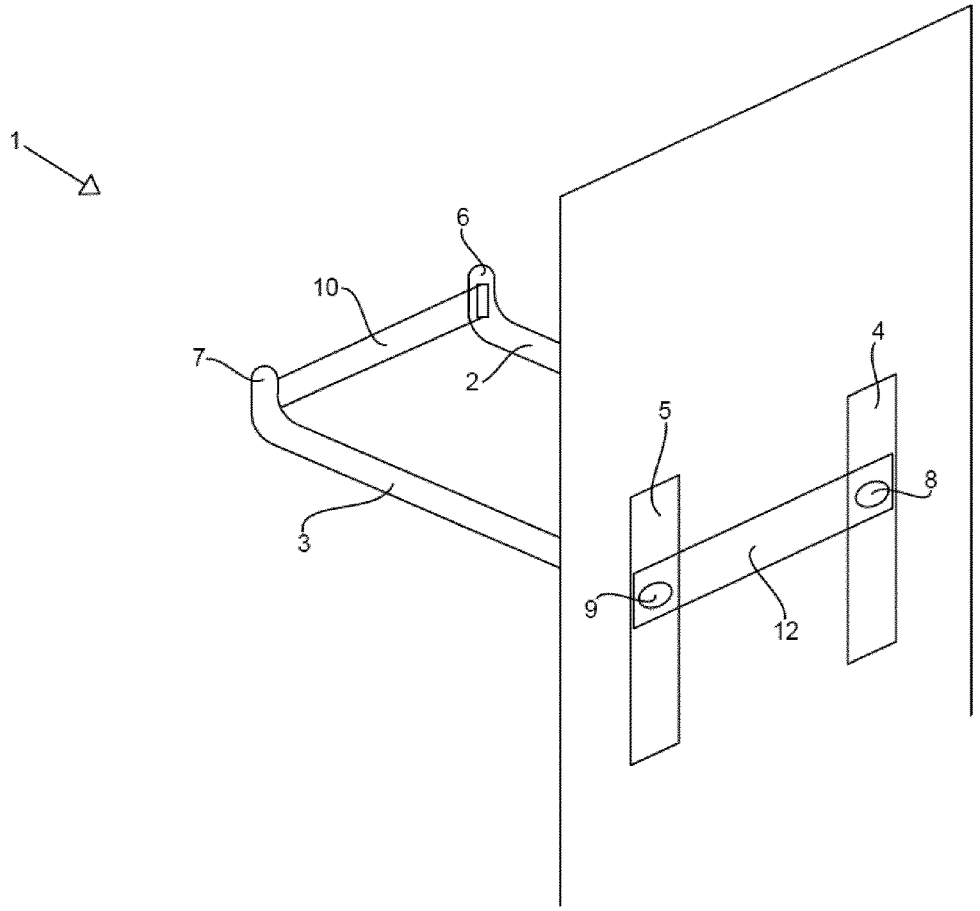
FIG. 4 is a schematic illustration in perspective view of the axillary support device 1 according to one embodiment, in which it is observed that the transverse arms 2, 3, at the respective ends 8, 9, are reversibly constrained to a bar 12 arranged transversely thereto. The bar 12 is reversibly constrained to the vertical supports 4, 5 and can translate in vertical direction therealong; in addition, the transverse arms 2, 3 can translate in horizontal direction along said bar 12.
Figure 5:
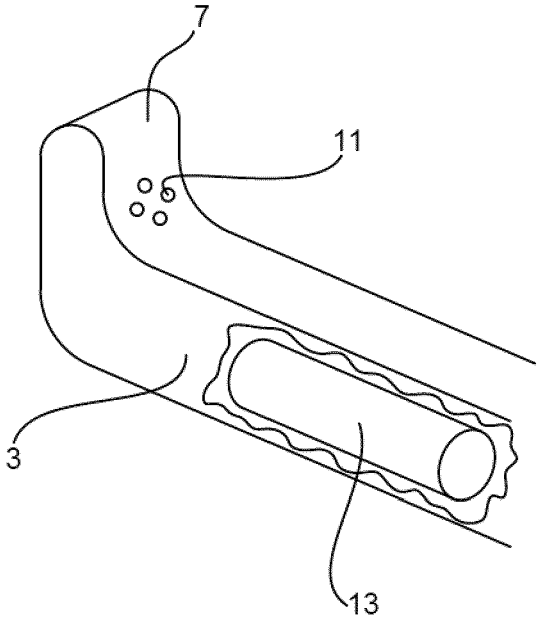
FIG. 5 is a schematic illustration in perspective view of a transverse arm 3 of the axillary support device 1 according to one embodiment, in which it is observed that said transverse arm 3 is provided with a watertight push-button panel 11 adapted to drive an electric motor 13, shown in the cross-section of the Figure, received in the transverse arm 3 which allows the vertical and/or horizontal movement thereof.
Figure 6:
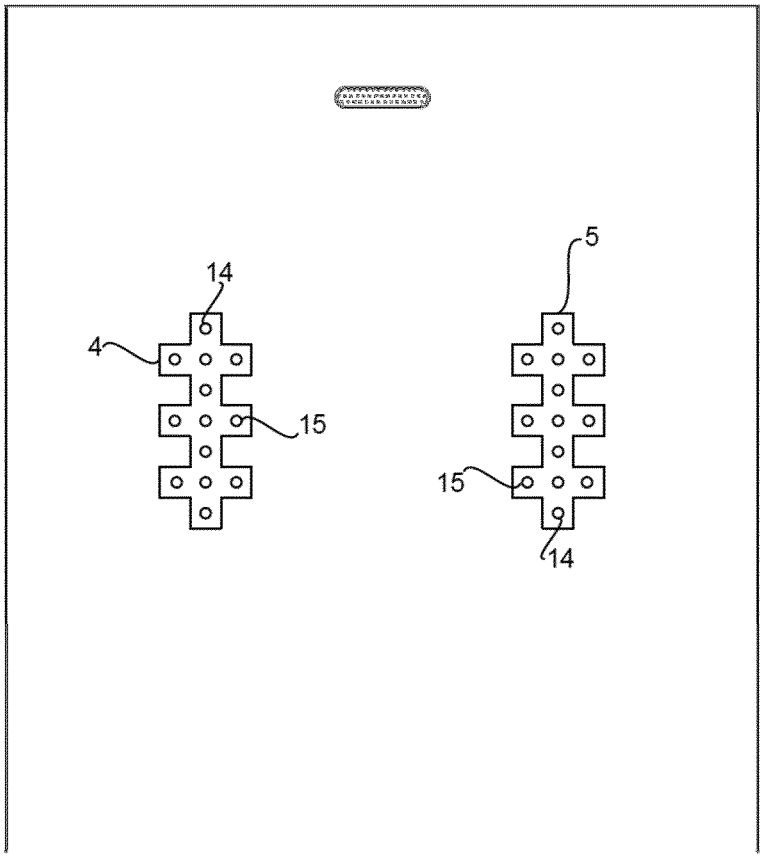
FIG. 6 is a schematic illustration in front view of the of the vertical supports 4, 5 of the device 1 according to one embodiment, each provided with a vertical row 14 of holes and with a plurality of horizontal rows 15 of holes, arranged transverse to said vertical row 14, said holes being adapted to receive and lock the transverse arms 2, 3 in position.

The invention will now be described in detail by means of examples of embodiments thereof and by making reference to the enclosed figures.

According to one particularly preferred embodiment, such device 1 is constituted by two transverse arms 2, 3, of which one end 8, 9 is firmly and reversibly fixed by means of a common fixing mechanism to a respective vertical support 4, 5 which is firmly constrained to a wall of a common shower stall, in a manner such that said transverse arms 2, 3 are substantially perpendicular, in the longitudinal direction thereof, to said wall.

Each vertical support 4, 5 is preferably constituted by a rail provided with at least one vertical guide and by a plurality of horizontal guides 12 arranged transverse to said vertical guide, due to which it is possible to carry out an independent translation, and in pre-established positions, of each transverse arm 2, 3 along said guides both in vertical direction and in horizontal direction. It is thus possible to adjust the vertical position and the horizontal position of the two transverse arms 2, 3 independently from each other.

Each transverse arm 2, 3 is provided with one end 6, 7 bent upward as an elbow, in particular said end 6, 7 being that opposite the end 8, 9 fixed to the respective vertical support 4, 5.

Inside the bent end 6 of a first 2 of the two transverse arms 2, 3, an extractable retention band 10 is housed by means of a common winding mechanism. Said retention band 10 can be extracted from the bent end 6 of said first transverse arm 2 by means of a suitable slit, placed on the internal side of said bent end 6. Once extracted, such retention band 10 can be firmly and reversibly fixed to the second of said transverse arms, by means of a common coupling means placed at the internal side of the bent end 7 of said second transverse arm 3. Each transverse arm 2, 3 is also provided with a covering made of any one soft and impermeable material, such as polymer foams or rubbers.

Preferably, the transverse arms 2, 3 and the vertical supports 4, 5 are made of corrosion-resistant metal material, e.g. stainless steel, and/or any rigid plastic material, for example polypropylene (PP).

The transverse arms 2, 3 preferably have circular section with a diameter preferably comprised between 3 and 8 cm, more preferably equal to about 5 cm. The length of the transverse arms 2, 3, up to the bent end 6, 7, is preferably comprised between 30 and 80 cm, more preferably between 40 and 70, still more preferably is equal to about 55 cm. The length of the bent end 6, 7 is preferably comprised between 10 and 25 cm, more preferably is equal to about 15 cm. The distance between the vertical guides of the vertical supports 4, 5 is preferably comprised between 30 and 80 cm, more preferably between 40 and 70 cm, still more preferably is equal to about 60 cm. Each transverse arm 2, 3 can be moved in vertical direction along said vertical guides, having a length comprised preferably between 40 and 130 cm, more preferably between 50 and 110 cm, still more preferably equal to about 90 cm, by carrying out discrete movements of length preferably comprised between 1 and 15 cm, more preferably equal to about 5 cm. Each transverse arm 2, 3 can also be moved along said horizontal guides, having a length preferably comprised between 5 and 30 cm, more preferably equal to about 20 cm, by carrying out discrete movements of a length preferably comprised between 1 and 10 cm, more preferably equal to about 5 cm. The number of the horizontal guides, arranged transverse to the vertical guides, is preferably comprised between 3 and 20, more preferably between 5 and 15, still more preferably is equal to 9. In addition, the angle that the bent end 6, 7 forms with the remaining portion of transverse arm 2, 3 is preferably, but not exclusively, equal to about 90°.

Due to the device 1, object of the present invention, the operations for cleaning people with limited physical mobility, carried out in a common shower stall, are considerably facilitated. Indeed, the transverse arms 2, 3 are adapted to provide axillary support to a person while he is situated inside the shower stall; such person can easily stand on his feet by firmly leaning on said transverse arms 2, 3. The covering made of soft and impermeable material, such as a polymer foam or a rubber, provides greater comfort during the support. Due to the free ends 6, 7 bent upward like an elbow of said transverse arms 2, 3, a further point of support is provided for people, which in this case does not run the risk of sliding forward or back, depending on the position where the transverse arms are rested. The retention band 10 also provides a further point of support for the front or rear part of the bust, thus ensuring maximum safety during device 1 use. In addition, given that said band 10 is extractable, it is possible to adapt the length thereof as a function of how the distance between the transverse arms 2, 3 has been regulated.

Due to the fact that the transverse arms 2, 3 can be translated along the guides, both in vertical direction and in horizontal direction, high adaptability is provided, making the device 1, object of the present invention, easily usable by people of any height and build.

In addition, it is particularly advantageous that the vertical position can be independently adjusted for each arm 2, 3. In this manner, a person with anatomical asymmetries, such as heterometry of the lower limbs, can adapt the axillary support device 1 to his needs.

As required, the transverse arms 2, 3 can be dismounted from the respective vertical supports 4, 5, in a manner so to avoid obstructing the shower stall.

According to one embodiment of the invention, the transverse arms 2, 3 are telescopic. It is therefore possible to vary the length of the transverse arms 2, 3 according to discrete and pre-established movements, in order to provide greater adaptability of the device 1 to people of any build/body size.

According to one embodiment, the covering made of soft and impermeable material, such as polymer foams or rubbers, is removable, given that it is fixed to the transverse arms in a reversible manner, e.g. by means of shook and loop fasteners. Such solution is particularly advantageous since it is possible to easily substitute said covering, for example due to wear or for hygiene reasons, e.g. if multiple people with limited physical mobility intend to use the same axillary support device 1.

According to one embodiment of the invention, the transverse arms are pivoted to the respective vertical supports 4, 5 in a manner such that they can be rotated up to 90°. In this manner, once the transverse arms 2, 3 are positioned and fixed at different heights from each other, it is possible to inwardly rotate them until they are substantially parallel to the wall of the shower to which they are fixed. This embodiment is particularly advantageous for the purpose of providing minimum bulk inside the shower stall, without having to remove the transverse arms from the respective vertical supports 4, 5.

According to one embodiment, the vertical position and the horizontal position of the transverse arms 2, 3 can be electrically adjusted. According to such embodiment of the invention, the transverse arms are coupled to the relative vertical supports 4, 5 by means of a common gear. In addition, inside each arm 2, 3, an electric motor 13 is housed that is power supplied for example by a common electric current outlet; due to such motor, it is possible to move the transverse arms 2, 3. Such operation is carried out by means of a watertight push-button panel 11 provided with at least four keys, including two for the vertical movement, upward and downward, and two for the horizontal movement, to the right and to the left. Each transverse arm 2, 3 is provided with said watertight push-button panel 11, in a manner such to be able to adjust the vertical and horizontal position of each transverse arm 2, 3 independently from each other.

Said gear is preferably obtained by providing the vertical supports 4, 5 constituted by a rack, and by providing the transverse arms 2, 3 with a toothed wheel at the respective ends 8, 9.

Such solution, in particular when a common seat is provided for a shower, is particularly advantageous. Indeed, a person with limited physical mobility can enter inside the shower stall and remain in a seated position on the seat. Subsequently, once leaning on the transverse arms 2, 3, such person can move such arms, simultaneously translating them upward, thus making use of a considerable aid for standing on one's feet. In a similar manner, the opposite operation can be carried out when it is desired to leave the shower stall. According to one embodiment of the invention, the transverse arms 2, 3 are joined together by means of a metal bar 12 placed transverse to said transverse arms 2, 3, which can translate horizontally therealong and be locked in pre-established positions. Said bar 12 is constrained to the transverse arms by means of, for example, a common quick coupling/release mechanism. The bar 12 is also constrained to the vertical supports 4, 5, which allow the translation thereof in vertical direction. In this manner, both the transverse arms 2, 3 are integrally moved in vertical direction.

According to one embodiment, when the transverse arms 2, 3 are constrained to each other by means of the bar 12, said transverse arms 2, 3 are substantially electrically moved as described in the preceding embodiment. In this case, however, it is necessary to have a single electric motor and a single watertight push-button panel, since the transverse arms are integrally moved with respect to each other.

According to one embodiment of the invention, the vertical supports 4, 5 are constituted by a metal plate provided with a vertical row 14 of holes arranged at pre-established distances, and with a plurality of horizontal rows 15 of holes arranged at pre-established distances. By means of said holes, it is possible to firmly and reversibly fix the transverse arms 2, 3 to the respective vertical supports 4, 5 by means of common fixing systems, such as screws and bolts, or common quick coupling/release mechanisms.

It is specified that the embodiments of the invention, and in particular the structural details thereof, have been described by way of example, not intended to limit the scope of the present invention in any manner.

It is also specified that further structural variants, which will be clear to a man skilled in the art, do not depart from the scope of the present invention.

PREFERRED EMBODIMENT OF THE INVENTION

According to a particularly preferred embodiment of the invention, the axillary support device 1 is substantially constituted by two transverse arms 2, 3 and by the respective vertical supports 4, 5 fixed to the wall of a common shower stall. Each vertical support 4, 5 is constituted by a rail provided with a vertical guide and with a plurality of horizontal guides, placed transverse to said vertical guide. The transverse arms 2, 3 are reversibly and firmly constrained to the rails of the respective vertical supports 4, 5 by means of a common coupling/release mechanism. Each transverse arm 2, 3 has circular section with a diameter equal to 5 cm, and is shaped in a manner so as to have one end 6, 7 bent upward, forming an angle equal to 90°. The length of each transverse arm 2, 3 up to the bent end 6, 7 is equal to 55 cm, while the length of the bent end 6, 7 is preferably equal to 15 cm. The distance between the vertical guides of the vertical supports 4, 5 is equal to about 60 cm. Each transverse arm 2, 3 can be independently moved in vertical direction along said vertical guides, having a length equal to 90 cm, by carrying out discrete movements of length equal to 5 cm. Each transverse arm 2, 3 can also be independently moved along said horizontal guides, having a length preferably equal to 20 cm, by carrying out discrete movements of length equal to 5 cm. The number of the horizontal guides, arranged transverse to the vertical guides, is equal to 9. The transverse arms and the vertical supports 4, 5 are made of stainless steel, while the covering is made of silicone rubber. Such covering has a thickness equal to about 5 cm, fully winds around said transverse arms and is reversibly constrained thereto by means of hook and loop fasteners.

In addition, inside the bent end 6 of a first 2 of the two transverse arms 2, 3 an extractable retention band 10 is housed, by means of a common winding mechanism. Said retention band 10 can be extracted from the bent end 6 of said first transverse arm 2 by means of a suitable slit, placed on the internal side of said bent end 6. Once extracted, such retention band 10 can be fixed firmly and reversibly to the second 3 of said transverse arms, by means of a common coupling means placed at the internal end of the bent end 7 of said second transverse arm 3.

The invention claimed is:

1. An axillary support device for a handicapped user of a shower stall provided with at least one flat wall, comprising:

a pair of vertical supports constrained to the flat wall of a shower stall, wherein each vertical support includes a rail having at least one vertical guide and a plurality of horizontal guides arranged transverse to the at least one vertical guide;

a first and a second transverse arm, each transverse arm having one free end bent upward and one end reversibly constrained to the rail of the respective vertical support by means of a coupling mechanism, said reversibly constrained ends being adapted to carry out a vertical and/or horizontal translation of each transverse arm along said vertical and/or horizontal guides according to discrete pre-established positions and adapted to be locked in position and at the desired height of said transverse arms; and a retention band adapted to support the user, the retention band having a free end and being windable and received inside the bent end of the first transverse arms, said free end of the retention band being reversibly constrainable to the bent end of the second transverse arm;

said transverse arms being arranged in a manner so as to be substantially perpendicular, in the longitudinal direction thereof, to the wall to which they are fixed by means of the vertical supports and being adapted to support the weight of a person who leans on the device by means of an axillary zone of the person, facilitating the cleaning operations thereof.

2. The axillary support device according to claim 1, wherein said transverse arms are pivoted to the respective vertical supports with an articulation, in a manner such that they can be bent up to 90°.

3. The axillary support device according to claim 2, wherein the transverse arms are pivoted inwardly.

4. The axillary support device according to claim 1, wherein the pair of vertical supports and the pair of transverse arms are made of a corrosion-resistant metal material.

5. The axillary support device according to claim 4, wherein the corrosion-resistant metal material is one of a stainless steel or rigid plastic material.

6. The axillary support device according to claim 1, wherein the transverse arms are telescopic.

7. The axillary support device according to claim 1, wherein each transverse arm is electrically movable in the vertical and/or horizontal direction, independently from each other by means of an electric motor received inside each of said transverse arms, each transverse arm also being provided with a watertight push-button panel adapted to control such movement.

8. The axillary support device according to claim 1, wherein the transverse arms, at the respective ends, are joined together by means of a bar arranged transverse to said transverse arms which can translate horizontally therealong and be locked in pre-established positions by means of a mechanism, said bar being constrained to the transverse arms by means of a quick coupling/release mechanism, and said bar also being constrained to the vertical supports, by means of a mechanism that allows the translation thereof in a vertical direction, in a manner such that both transverse arms are integrally moved in the vertical direction, together with the bar.

9. The axillary support device according to claim 1, wherein the transverse arms are electrically movable in the vertical and/or horizontal direction, by means of an electric motor received inside one of said transverse arms, which is also provided with a watertight push-button panel adapted to control the movement of the transverse arms.

10. The axillary support device according to claim 1, wherein the vertical supports are constituted by a metal plate provided with a vertical row of holes arranged at pre-established distances and with a plurality of horizontal rows of holes arranged at pre-established distances, and that by means of said holes it is possible to firmly but reversibly fix the transverse arms to the respective vertical supports by means of fixing systems or quick coupling/release mechanisms.

11. The axillary support device according to claim 1, wherein each transverse arm further includes a covering made of a soft and impermeable material.

12. The axillary support device according to claim 11, wherein the covering of the transverse arms fully or partially winds around said transverse arms, said covering being reversibly constrained to said transverse arms.

13. The axillary support device according to claim 12, wherein the covering of the transverse arms is reversibly constrained to the transverse arms using hook and loop fasteners.

14. The axillary support device according to claim 11, wherein the covering of the transverse arms includes one or more polymer foams or rubbers.

15. The axillary support device according to claim 1, wherein the bent ends of the transverse arms have a length between 10 cm and 25 cm.

* * * * *